US010047951B2

(12) United States Patent
Cadeau et al.

(10) Patent No.: US 10,047,951 B2
(45) Date of Patent: Aug. 14, 2018

(54) GAS BURNER

(75) Inventors: Christophe Cadeau, Lipsheim (FR); Jörn Naumann, Offenburg (DE)

(73) Assignee: BSH Hausgeräte GmbH, Munich (DE)

( * ) Notice: Subject to any disclaimer, the term of this patent is extended or adjusted under 35 U.S.C. 154(b) by 1376 days.

(21) Appl. No.: 12/514,495

(22) PCT Filed: Nov. 12, 2007

(86) PCT No.: PCT/EP2007/062216
§ 371 (c)(1),
(2), (4) Date: Nov. 25, 2009

(87) PCT Pub. No.: WO2008/058934
PCT Pub. Date: May 22, 2008

(65) Prior Publication Data

US 2010/0092900 A1 Apr. 15, 2010

(30) Foreign Application Priority Data

Nov. 13, 2006 (DE) ..... 10 2006 053 425

(51) Int. Cl.

| | |
|---|---|
| ***F23Q 2/32*** | (2006.01) |
| ***F23D 5/00*** | (2006.01) |
| ***F23Q 7/08*** | (2006.01) |
| ***F23D 14/06*** | (2006.01) |
| *F24C 3/00* | (2006.01) |

(52) U.S. Cl.
CPC .. *F23D 14/065* (2013.01); *F23D 2900/14062* (2013.01)

(58) Field of Classification Search
USPC .... 431/159, 284, 198, 200, 253; 126/39 BA, 126/39 E, 39 K, 39 R, 39 H
See application file for complete search history.

(56) References Cited

U.S. PATENT DOCUMENTS

| | | | | |
|---|---|---|---|---|
| 917,186 | A * | 4/1909 | Thompson | F24C 3/085 126/39 H |
| 1,494,444 | A * | 5/1924 | Sass | F23D 14/06 126/29 |
| 2,186,588 | A * | 1/1940 | Leonard et al. | 126/39 R |
| 2,619,164 | A * | 11/1952 | Harper | F23D 14/06 431/284 |
| 2,847,988 | A * | 8/1958 | Hess | F23C 99/00 126/39 H |
| 2,891,608 | A * | 6/1959 | Mueller | F23D 14/065 431/194 |
| 5,277,576 | A | 1/1994 | Hartung et al. | |

(Continued)

FOREIGN PATENT DOCUMENTS

| | | |
|---|---|---|
| DE | 1918214 | 6/1965 |
| ES | 2204212 A1 | 4/2004 |

(Continued)

*Primary Examiner* — Steven B McAllister
*Assistant Examiner* — Desmond C Peyton
(74) *Attorney, Agent, or Firm* — Michael E. Tschupp; Andre Pallapies; Brandon G. Braun

(57) ABSTRACT

A gas burner including a gas inlet opening, a gas chamber connected to the gas inlet opening, and a gas input chamber connecting the gas inlet opening and the gas chamber, wherein the gas input chamber leads out from the gas inlet opening into the gas chamber in an at least partially upward angled manner.

18 Claims, 6 Drawing Sheets

(56) References Cited

U.S. PATENT DOCUMENTS

| | | | | |
|---|---|---|---|---|
| 5,401,164 | A | 3/1995 | Yen | |
| 5,639,232 | A | 6/1997 | Bogenschutz et al. | |
| 6,780,008 | B2 | 8/2004 | Koch et al. | |
| 2001/0010897 | A1 | 8/2001 | Dane | |
| 2003/0228550 | A1 | 12/2003 | Koch et al. | |
| 2004/0219466 | A1* | 11/2004 | Marino et al. | 431/9 |
| 2008/0241777 | A1 | 10/2008 | Rossi et al. | |
| 2009/0047611 | A1 | 2/2009 | Armanni | |

FOREIGN PATENT DOCUMENTS

| | | | | |
|---|---|---|---|---|
| GB | 1599983 | | 10/1981 | |
| GB | 2223302 | A | 4/1990 | |
| JP | 200629716 | A | 2/2006 | |
| WO | WO 49338 | A1 * | 8/2000 | F23D 14/06 |
| WO | 0225170 | A1 | 3/2002 | |
| WO | WO2006117815 | A1 | 11/2006 | |

* cited by examiner

GAS BURNER

BACKGROUND OF THE INVENTION

A gas burner is known from DE 41 25 308 A1, in which a centrically disposed gas inlet opening leads horizontally into a narrow, high annular gas chamber. The annular gas chamber rises upward at an angle at its lower face from the gas inlet opening to the opposite side. The annular gas chamber is open at the top and is covered by an annular burner circuit. The annular configuration of the gas chamber means that a gas-free inner region (assembly region) is formed, which is closed off at the top by the insertion of an inner burner to seal the gas burner off from external influences. A thermocouple and a spark ignition are generally secured in the inner region in proximity to the inner burner. This gas burner has the disadvantage that the gas/air mixture flowing in through the gas inlet opening strikes the almost vertical side wall of the narrow gas chamber essentially frontally. As a result some of the gas/air mixture is reflected back in the direction of the gas inlet opening, leading to a pressure loss and a less efficient primary air intake.

A gas burner is also known from WO 02/25170 A1 for example, in which the gas is taken in through an eccentrically disposed gas inlet opening and which merges directly into an annular gas chamber in a lateral manner. The gas/air mixture here flows into the annular gas chamber in an essentially straight line but the one-sided peripheral flow means that there is irregular gas distribution to the upward pointing gas outlet openings. A gas-free inner region (assembly region) is formed here too, to seal the gas burner off from external influences and to accommodate an inner burner, a thermocouple and a spark ignition.

SUMMARY OF THE INVENTION

The object of the invention is therefore to find a possible means of reducing the pressure loss within the burner while at the same time providing sufficiently regular distribution of the gas/air mixture with the smallest possible burner dimensions.

The object is achieved by a gas burner according to the exemplary embodiments described herein.

To this end the gas burner has a gas inlet opening and a gas chamber connected thereto, the gas inlet opening and the gas chamber being connected by way of a gas input chamber and the gas input chamber leading out from the gas inlet opening into the gas chamber in an at least partially upward angled manner.

The angled and therefore "smooth" gas transition from the gas inlet opening to the gas chamber means that only a small amount of the gas flowing through the gas inlet opening is reflected back from the gas chamber or gas input chamber, so no pressure drop is caused. The gas chamber itself can also be designed to be relatively flat with adequate distribution of the gas/air mixture and as it is no longer a function of the height or position of the gas inlet opening, the gas flow no longer has to be conveyed in a peripheral manner.

It may be favorable for a simple embodiment of the burner and for simple gas conveyance if the gas chamber is disposed in its entirety above the gas inlet opening.

It is particularly favorable if the gas chamber has a disk-shaped base form, at least in plan view, as this allows a much flatter structure for an identical volume compared with the annular gas chamber and the gas can also be propagated into the gas chamber over a larger area, allowing more regular gas distribution.

For flexible design of the burner it is favorable if the gas chamber is of variable height, in particular if the gas chamber has a partial gas chamber curving upward above the gas input chamber.

It is advantageous for flexible design and volume minimization if an inner burner, a guide for a thermocouple and/or a guide for a spark ignition, optionally in the form of a shared guide, are passed through the gas chamber and not through a gas-free assembly chamber, as this allows a disadvantageous annular configuration of the gas chamber to be avoided.

It is advantageous for regular gas distribution if the gas input chamber widens at least partially in a lateral manner from the gas inlet opening toward the gas chamber, in particular in a fan shape.

BRIEF DESCRIPTION OF THE DRAWINGS

A gas burner is described schematically in more detail in the exemplary embodiment below. Identical elements are shown with identical reference characters in all the figures. The exemplary embodiment is not intended to restrict the invention. In the drawings.

DETAILED DESCRIPTION OF THE EXEMPLARY EMBODIMENTS OF THE PRESENT INVENTION

Figure 1:
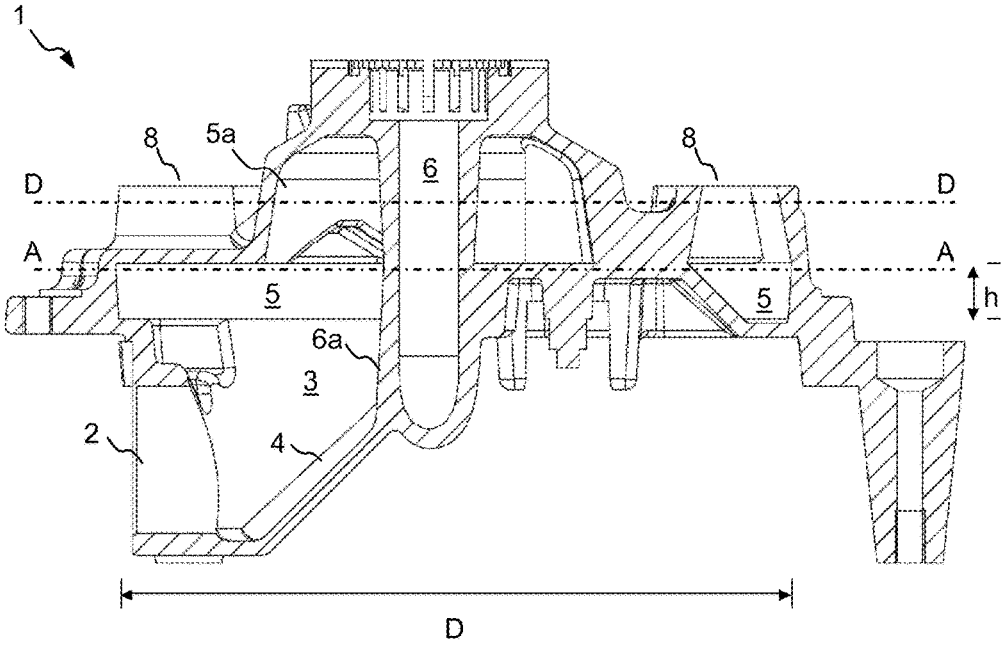
FIG. 1 shows a sectional diagram of a side view of a gas burner.

The gas burner 1 has a gas inlet opening 2, which leads into a gas input chamber 3. The gas input chamber 3 rises at least partially by means of an angled base wall 4 into a gas chamber 5 disposed above the gas input chamber 3. The gas chamber 5 has a disk-shaped base form. An inner burner 6 and the receiving region 7 for a thermocouple and spark ignition are integrated in the gas chamber 5. The gas chamber 5 opens at the top in the form of an arched gas flue 8. A burner ring (not shown) can be positioned on the gas flue 8, to enclose an inner burner chamber with the inner burner 6, a main flame being produced at its outer periphery.

The gas chamber 5 can have a variable height h. It is flat compared with the prior art, in other words its maximum diameter D is greater than its maximum height h.

The gas chamber 5 has an upward curving centric partial gas chamber **5*a* above the gas input chamber 3**.

Gas flowing into the gas input chamber 3 from the gas inlet opening 2 is routed into the gas chamber 5 by the angled surface 4 without significant pressure loss. The gas flow from the gas flues 8 is essentially regularly distributed here, as the inner burner wall **6*a* starts in the upper region of the angled base wall 4 and the through openings 10, receiving region 7 and centric partial gas chamber 5*a* are disposed there so that the gas flow is distributed in the remainder of the gas chamber 5 without major pressure loss and can flow out of the gas flues 8. This manner of deflection reduces the pressure loss in the gas flow, resulting in a greater throughflow speed of the gas flow and thus more effective primary air intake, in turn resulting in better combustion characteristics, see also FIGS. 1, 3, 4, 6**.

Figure 2:
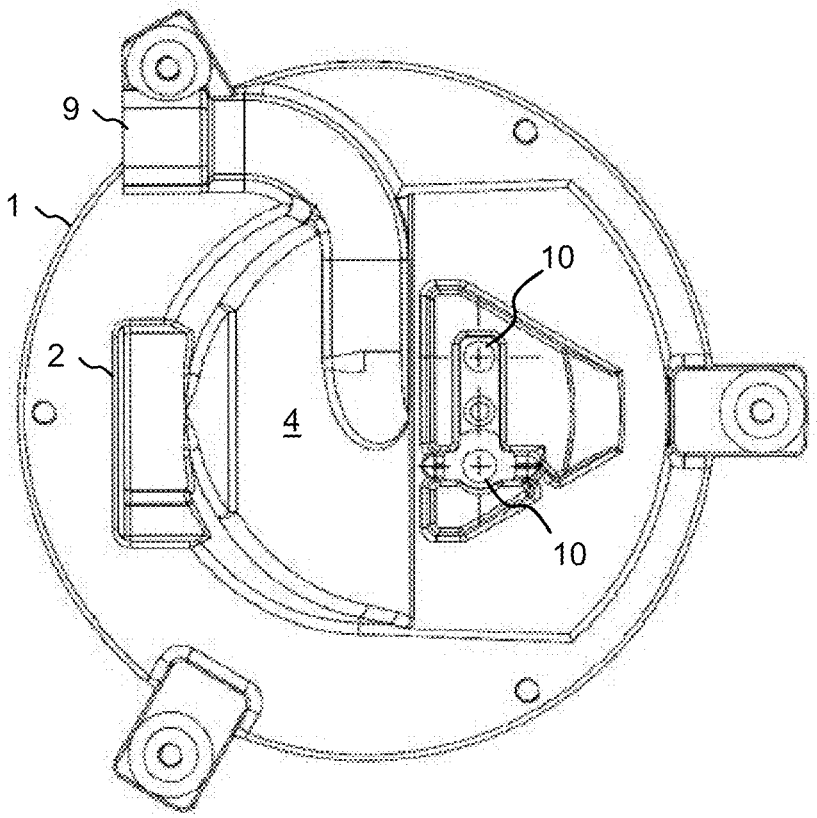
FIG. 2 shows the gas burner from FIG. 1 from below.

FIG. 2 shows the gas burner 1 from FIG. 1 from below with the gas inlet opening 2 for the main flame or the outer circuit, the angled base wall 4 of the gas input chamber and a further gas connection 9 to supply the inner burner and through holes 10 for guiding the spark ignition and thermocouple. The angled base wall 4 and therefore the gas input chamber 3 widen at least partially in a lateral manner from the gas inlet opening 2 to the gas chamber.

Figure 3:
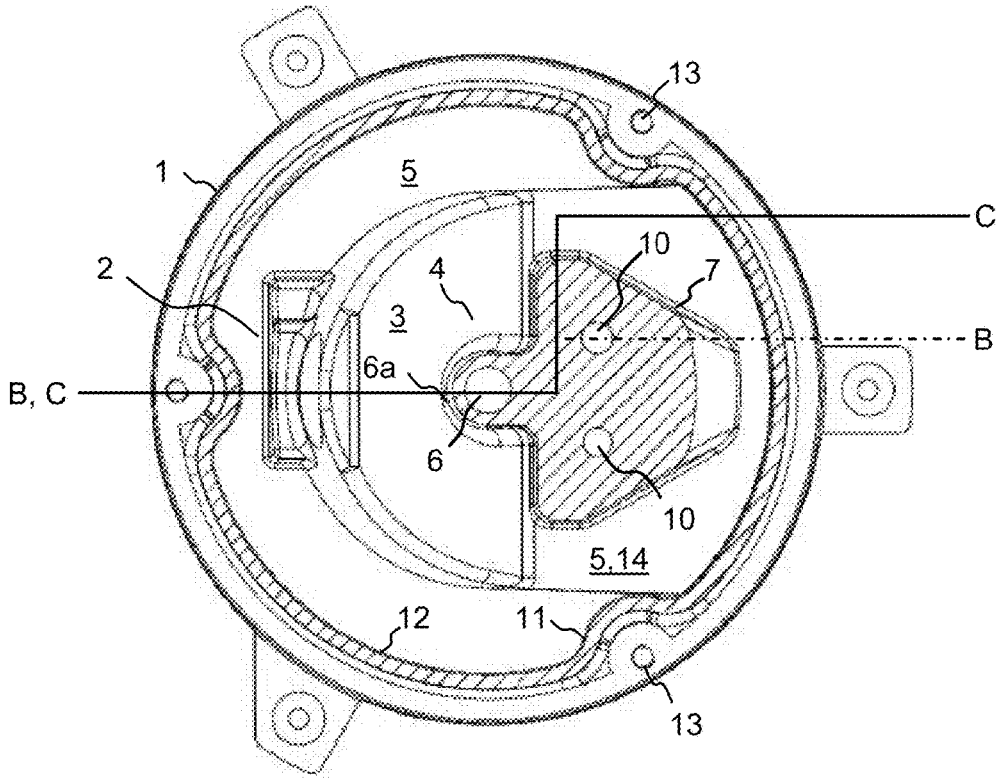
FIG. 3 shows a plan view of the gas burner from FIG. 1 along a section line A-A from FIG. 1.

FIG. 3 shows a plan view of the gas burner 1 from FIG. 1 along a section line A-A from FIG. 1. As in FIG. 2, the angled base wall 4 and therefore the gas input chamber 3 widen from the gas inlet opening 2 to the gas chamber 5. The gas chamber 5 has a disk-shaped base form and only deviates from this at projections 11 in the side wall 12 to circumvent screw holes 13. The receiving region 7 for the thermocouple and spark ignition has corresponding through holes 10 and is configured as a single piece with the inner burner 6.

Figure 4:
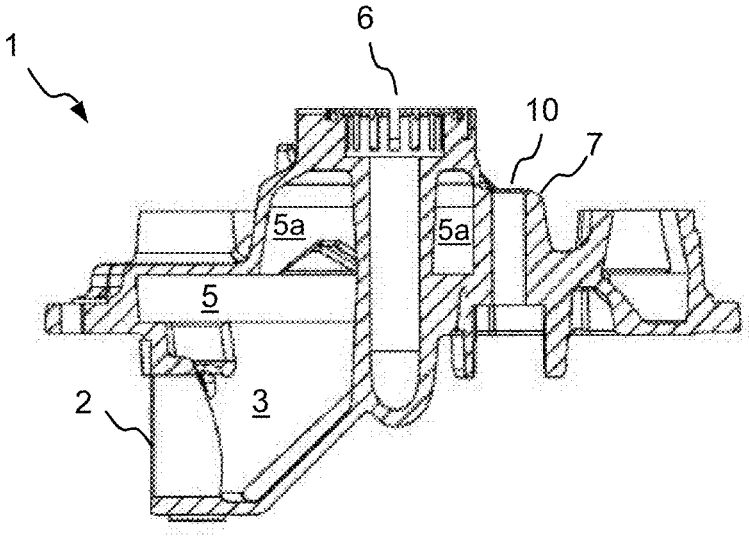
FIG. 4 shows a sectional diagram of a side view as in FIG. 1 along the section line B-B from FIG. 3.

FIG. 4 shows a sectional diagram of a side view as in FIG. 1 along the section line B-B from FIG. 3. This view shows one of the through holes 10 in the receiving region 7 for the spark ignition and/or thermocouple.

Figure 5:
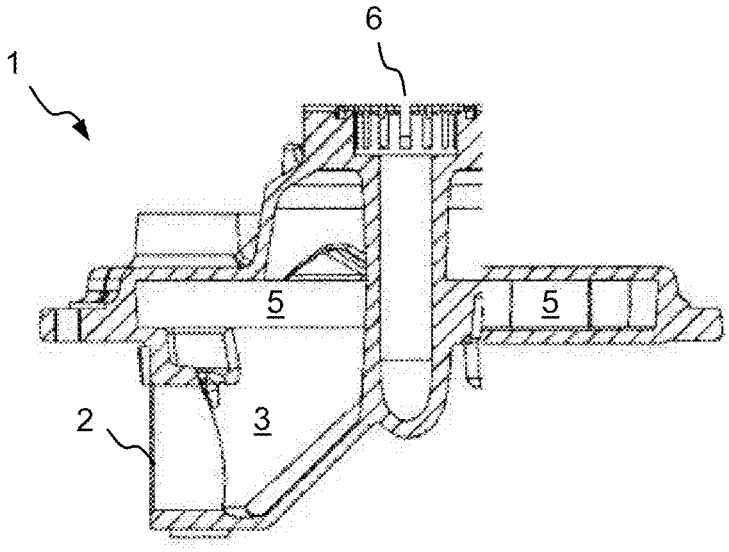
FIG. 5 shows a sectional diagram of a side view as in FIG. 1 along the section line C-C from FIG. 3.

FIG. 5 shows a sectional diagram of a side view as in FIG. 1 along the section line C-C from FIG. 3, in which the disk shape of the gas chamber 5 can clearly be seen.

Figure 6:
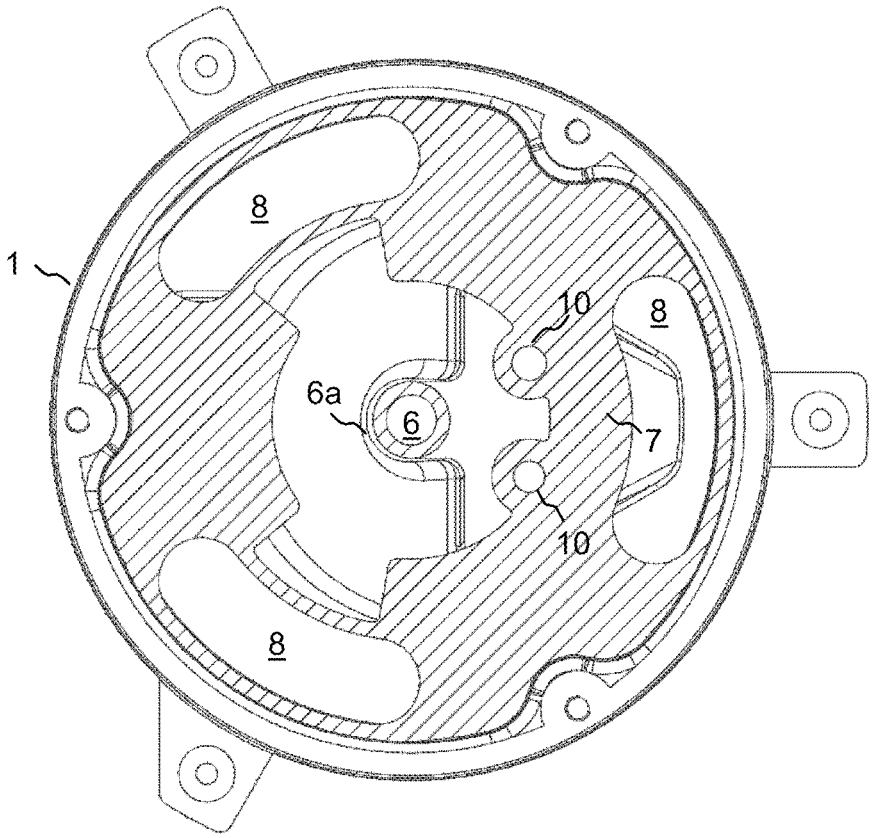
FIG. 6 shows a plan view of the gas burner from FIG. 1 along a section line D-D from FIG. 1.

FIG. 6 shows a plan view of the gas burner from FIG. 1 along a section line D-D from FIG. 1 with the three gas flues 8, the centrically disposed inner burner 6 and the through holes 10 for the spark ignition and/or thermocouple.

The invention is not restricted to the illustrated exemplary embodiment. Flow baffles can thus be used, for example where there are deviations from the laterally centric arrangement of the gas inlet opening. The gas input chamber can also be formed differently, in particular the angled base wall and/or the form of the lateral widening. The thermocouple and spark ignition can also be guided outside the gas chamber.

LIST OF REFERENCE CHARACTERS

1 Gas burner
2 Gas inlet opening
3 Gas input chamber
4 Angled base wall
5 Gas chamber
5*a* Centric partial gas chamber
6 Inner burner
6*a* Inner burner wall
7 Receiving region
8 Gas flue
9 Gas connection
10 Through hole
11 Projection
12 Side wall
13 Screw hole
h Height
D Diameter

The invention claimed is:

1. A gas burner comprising:
a gas inlet opening;
a gas chamber connected to the gas inlet opening; and
a gas input chamber connecting the gas inlet opening and the gas chamber and defining a gas flow path between the gas inlet opening and the gas chamber, the gas input chamber including a base portion having a plate, and the plate being at an acute angle with respect to a plane containing the gas inlet opening to smoothly direct gas flow through the gas input chamber from the gas inlet opening to the gas chamber,
wherein the plate has a truncated semi circular form,
wherein the gas chamber is disk-shaped and extends radially beyond the gas input chamber.

2. The gas burner as claimed in claim 1, wherein the gas chamber is disposed above the gas inlet opening.

3. The gas burner as claimed in claim 1, wherein the gas chamber has a variable height.

4. The gas burner as claimed in claim 3, wherein the gas chamber has a partial gas chamber curving upward.

5. The gas burner as claimed in claim 4, wherein the gas chamber is centrically disposed above the gas input chamber.

6. The gas burner as claimed in claim 5, wherein the partial gas chamber is disposed centrically.

7. The gas burner as claimed in claim 1, further comprising an inner burner configured as a single piece and having a receiving region for a thermocouple and a spark ignition wherein the inner burner is disposed in the gas chamber.

8. The gas burner as claimed in claim 1, wherein the gas inlet opening is disposed centrically in a lateral manner.

9. A gas burner comprising:
a gas inlet opening;
a gas chamber connected to the gas inlet opening; and
a gas input chamber connecting the gas inlet opening and the gas chamber and defining a gas flow path between the gas inlet opening and the gas chamber, the gas input chamber including a base portion having an angled base wall, and the angled base wall being at an acute angle with respect to a plane containing the gas inlet opening to smoothly direct gas flow through the gas input chamber from the gas inlet opening to the gas chamber
wherein the angled base wall of the gas input chamber is formed as a truncated semi-circular plate, wherein the gas chamber is disk-shaped and extends radially beyond the gas input chamber.

10. The gas burner as claimed in claim 9, wherein the angled base wall widens laterally from the gas inlet opening to the gas chamber.

11. The gas burner as claimed in claim 1 wherein the gas chamber extends radially beyond an outer radial extent of the gas input chamber.

12. The gas burner as claimed in claim 1, wherein the plate is positioned such that its truncated semi-circular form has its diameter located adjacent to the gas chamber.

13. The gas burner as claimed in claim 7, wherein the plate extends around a portion of the inner burner.

14. The gas burner as claimed in claim 9, wherein the plate is positioned such that its truncated semi-circular form has its diameter located adjacent to the gas chamber.

15. The gas burner as claimed in claim 9, further comprising an inner burner configured as a single piece and having a receiving region for a thermocouple and a spark ignition wherein the inner burner is disposed in the gas chamber.

16. The gas burner as claimed in claim 15, wherein the plate extends around a portion of the inner burner.

17. The gas burner as claimed in claim 16, wherein the plate has a semi-circular cut-out that extends around the portion of the inner burner.

18. The gas burner as claimed in claim 13, wherein the plate has a semi-circular cut-out that extends around the portion of the inner burner.

* * * * *